United States Patent [19]

Liaw

[11] Patent Number: 4,666,085

[45] Date of Patent: May 19, 1987

[54] MULTIPLE PURPOSE WATER SPRAY GUN

[76] Inventor: Maw-Shinn Liaw, No. 5, Alley 2, Lane 124, Sec. 3, Chien-Kuo Rd., Minhsiung Hsiang Chiayi Hsien, Taiwan

[21] Appl. No.: 817,424

[22] Filed: Jan. 9, 1986

[51] Int. Cl.[4] ..... B05B 1/12; B05B 1/16

[52] U.S. Cl. ..... 239/394; 239/490; 239/493; 239/526; 239/574

[58] Field of Search ..... 239/394, 525, 526, 553, 239/553.3, 553.5, 583, 590.5, 493, 490, 574

[56] References Cited

U.S. PATENT DOCUMENTS

| | | | |
|---|---|---|---|
| 469,211 | 2/1892 | Kline | 239/553.5 |
| 2,974,880 | 3/1961 | Stewart et al. | 239/493 |
| 3,100,084 | 8/1963 | Biber | 239/493 |
| 3,516,611 | 6/1970 | Piggott | 239/394 |
| 3,799,447 | 3/1974 | Beal | 239/526 |
| 3,814,326 | 6/1974 | Bartlett | 239/394 |
| 4,219,162 | 8/1980 | Dadson | 239/526 |
| 4,534,512 | 8/1985 | Chow et al. | 239/394 |

FOREIGN PATENT DOCUMENTS

| | | | |
|---|---|---|---|
| 333149 | 6/1920 | Fed. Rep. of Germany | 239/553.5 |
| 2558796 | 7/1977 | Fed. Rep. of Germany | 239/394 |

*Primary Examiner*—Joseph F. Peters, Jr.
*Assistant Examiner*—Michael J. Forman
*Attorney, Agent, or Firm*—Bucknam and Archer

[57] ABSTRACT

A multiple purpose water spray gun comprises: a main body, a revolving ring, a water control rod, a press trigger, a seal plate and an adjusting knob, wherein at the front end of the revolving ring, five nozzles of different types are arranged for various purposes. One of the nozzles is a rain-drop nozzle consisting of a central recessed hole where water is led in, a plurality of grooves which are radially disposed around the recessed hole and by each of which the water is conducted into a different large opening to then pass through a small hole to spray out as mist. The press trigger and the main body have matched lugs for direct pressing together to save assembling cost; leakage prevention rings are provided along the front and rear ends of the water control rod, to ensure perfectly tight seals.

2 Claims, 6 Drawing Figures

MULTIPLE PURPOSE WATER SPRAY GUN

BACKGROUND OF THE INVENTION

The present invention relates generally to water spray gun and more particularly to a water spray gun having revolving nozzles that can meet a multiplicity of purposes.

Usually, a water spray gun is used for horticulture or gardening, but it can be also applied for car washing or ground cleaning; since a plurality purposes may be required, composite designs become popular. However, water spray guns which are known nowadays might have the following drawbacks:

(1) Failure in supplying extra fine mists when needed for watering delicate plants such as orchids;

(2) Riveting is generally used to connect the trigger with the gun body, this is time consuming and expensive. Once the connection is broken, the whole gun becomes a waste, since repairing is beyond the capacity of a user.

(3) Constructions are not good enough to prevent frequent leakage.

SUMMARY OF THE INVENTION

The present invention aims at providing a novel water spray gun the rigidity of which is improved and which is more practical.

Therefore the main object of the present invention is to provide a water spray gun that is capable of delivering V shaped spray, rain drops, mist, jet and shower through different nozzles arranged on a revolving ring to be suited for versatile purposes.

Another object of the present invention is to provide a water spray gun of better construction where the press trigger handle can be directly clipped onto the main body to save assembly time as well as the cost, and also to facilitate changing of parts upon breakdown.

A further object of the present invention is to provide a water spray gun with such a design that the leakage problem is greatly improved.

BRIEF DESCRIPTION OF THE DRAWING

Other objects and features of the present invention will become apparent through the following detailed description accompanying with the annexed drawings, where.

DETAILED DESCRIPTION OF THE PREFERRED EMBODIMENT

Figure 1:
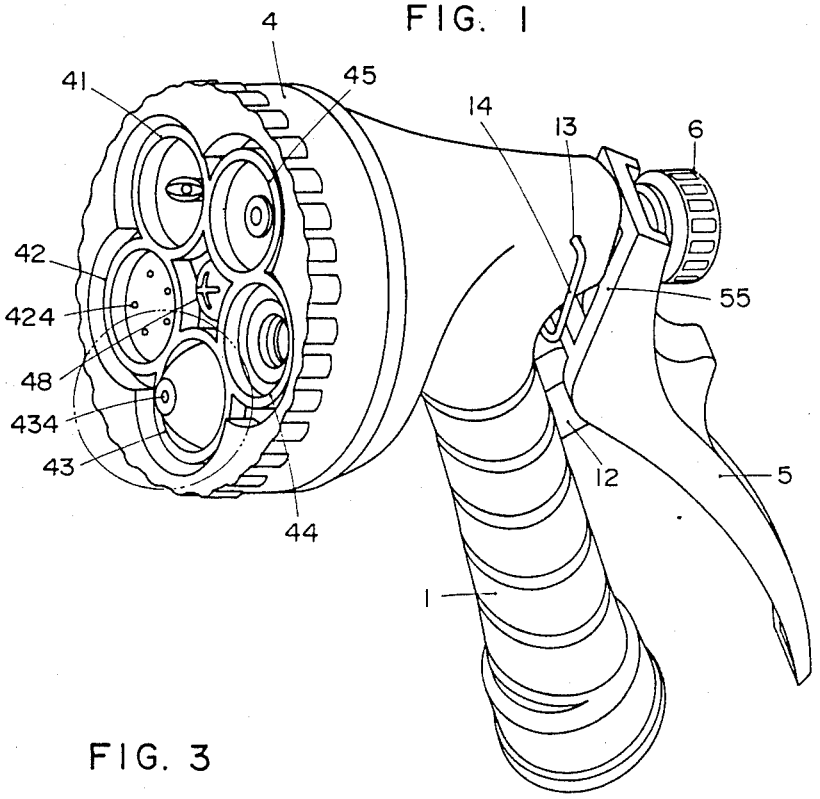
FIG. 1 is a perspective view of a water spray gun according to a preferred embodiment of the present invention.
Figure 2:
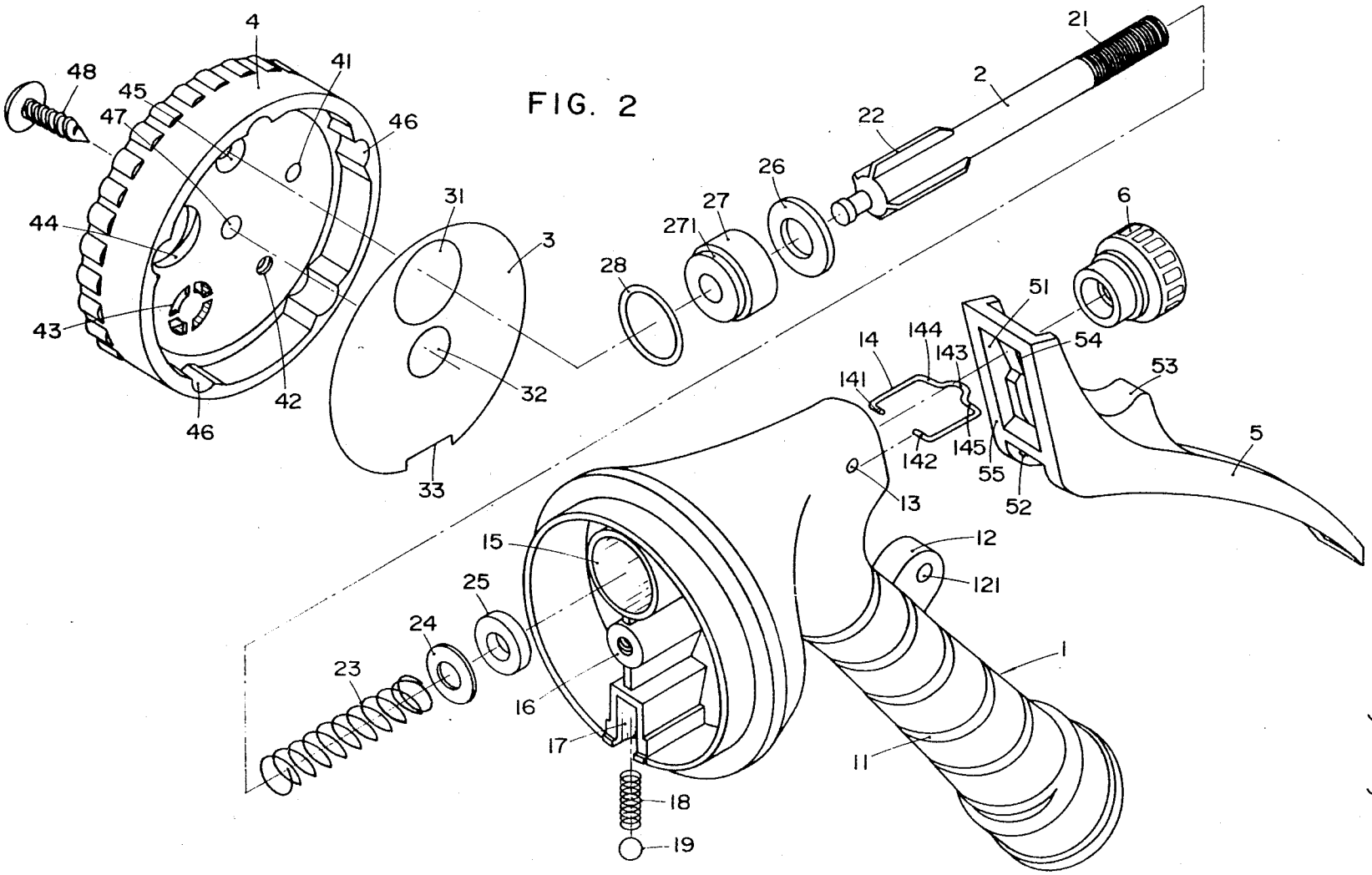
FIG. 2 is an exploded view of the same.

Now referring to FIGS. 1 and 2, the main body 1 consists of a spiral handle 11, on the upper part of which a lug 12 is provided with a pair of round pits 121 alongside; further up the handle, at a position corresponding to the center of a water supply pipe, a pair of side holes 13 is disposed for the connection of a fixing clip 14 which is generally U-shaped. The two legs of the U shaped clip are folded to form right angle parts 141, 142 for inserting into side holes 13—13; at the bottom of the U clip 14, a bulge 143 is formed. In FIG. 2, it can be seen that a water supply pipe 15 which is to connect a water intake within the handle 11, is located on the upper most part of the generally circular shaped body front. In the center of the body front and right under the pipe 15, there is a stud hole 16 for anchoring a stud 48 which shall be described later. Further under the central stud hole 16, a radially disposed slot 17 is provided for the retention of a positioning spring 18 and a steel ball 19.

Figure 5:
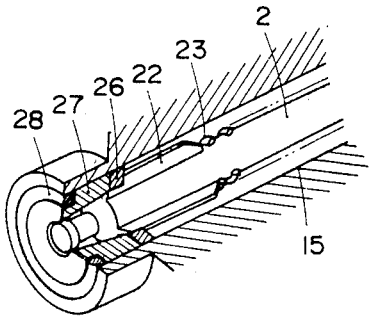
FIG. 5 is an partial cut-away perspective of the water control rod assembly 2 within a water supply pipe 15.

Referring to FIGS. 2 and 5, extending into the pipe 15 there is a water control rod 2. Rod 2 has male thread on its rear end and several water guide fins 22 on its front end. A spring 23 with its front end resting against the end of the fins 22 and its rear end against the inner wall of the main body 1, is disposed around the rod 2. Between the inner wall of the main body 1 and the rear end of the spring 23, there are arranged two water seal rings 24 and 25 for leakage prevention. In front of the fins 22, another water seal 26 is provided; there is also a water stop collar 27 fixed to the outlet of water pipe 15 by way of ultrasonic welding, and a further water seal 28 is disposed on the restricted end 271 of the collar 27 to ensure leak-proof sealing.

A seal plate 3 covers the circular front of the main body 1. In the plate 3, there are provided an opening 31 to communicate with the pipe 15, a center hole 32 corresponding to stud hole 16, and a bottom notch to facilitate the proper operation of spring 18 and ball 19.

Figure 6:
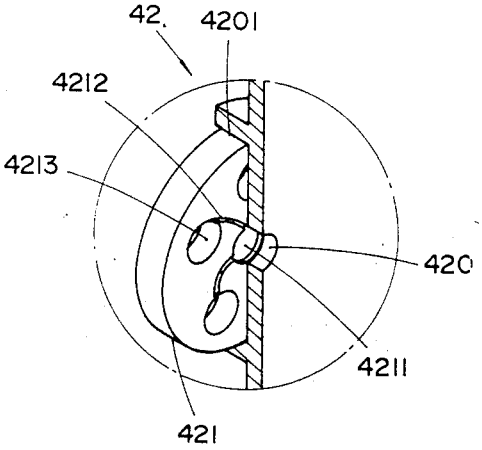
FIG. 6 is an enlarged perspective of the rain-drop nozzle 42 with a partial cut-away.

A revolving ring 4 is to be connected to the front circular face of the main body 1; five nozzles for different purpose are arranged on the ring 4 in a flower petalled manner. They are: V type nozzle 41, rain-drop nozzle 42, mist nozzle 43, jet nozzle 44 and shower nozzle 45. The rain-drop nozzle 42 is further detailed in FIG. 6. The nozzle 42 is composed of a concentration hole 420 formed in the center of a recessed wall. The hole 420 is covered up by a controlling part 421, part 421 having a central cavity 4211, along which a plurality of grooves 4212 are radially formed. Each groove 4212 leads tangentially to a hole 4213 of appropriate depth and the hole 4213 channels to a central micro exit 424 (shown in FIG. 1). Curved positioning track 46 is provided corresponding to each nozzle so as to be positively aligned with the water pipe 15 when the revolving ring 4 is rotated about the central stud 48 which is to mount the ring 4 onto the body 1 through a center hole 47 on the ring 4.

Figure 3:
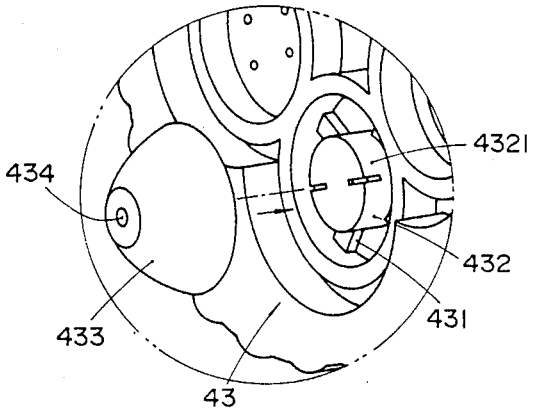
FIG. 3 is an enlarged perspective view of a mist producing nozzle 43 such as shown in a circle in FIG. 1.
Figure 4:
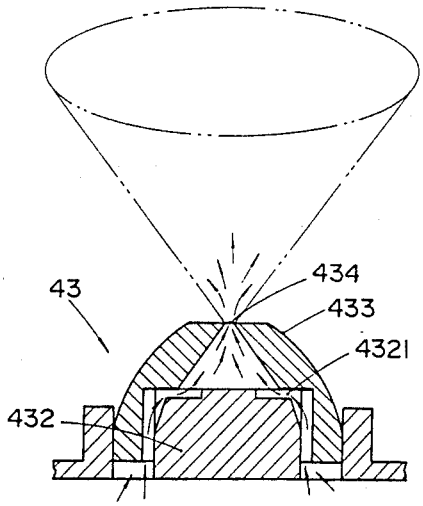
FIG. 4 is an elevational sectional view of the assembled nozzle 43.

Referring to FIGS. 3 and 4, the mist forming nozzle 43 comprises a recessed nozzle member 432 supported by ribs 431 and formed integrally with the ring 4, and a cover 433 covering the nozzle member 432. Starting from the side wall of nozzle member 432, there are provided two dimetrically disposed slots 4321 leading toward the top; water which flows through the opening 434 forms a mist cone such as shown in FIG. 4.

A press trigger handle 5 is connected to the rear portion of the main body handle 11, the handle 5 having recessed frame 51 extended therebelow and the two side walls are formed with spherical protrusions 52 so as to clip into the pits 121 formed on lug 12 of the main body 1. The back hump 53 of the handle 5 is to facilitate the press-triggering of the handle 5. In the center of the recess 51, an opening 54 is provided to let the threaded rear end 21 of the rod 2 extend therethrough. An adjusting knob 6 with female threading is to screw on to the male threaded rear end 21 of the rod 2.

Water is fed in through the bottom of the handle 11 of the main body 1 for use. Since the spring 23 is retained against the fin 22 of the rod 2 as well as the inner wall of the main body 1, by adjusting the knob 6, the rod 2 may be forced forward or backward so as to control the flow of water passing through the gap between the front end of the rod 2 and the collar 27.

Since the revolving ring 4 is capable of rotating about the stud 48 in front of the main body 1, each nozzle can be rotated to align with the water pipe 15 to get a selected performance. Ball 19 is forced against the spring 18 when rotation of the ring 4 is effected; once an alignment position is reached, the ball 19 is forced out by the spring 18 to fall within a corresponding positioning track 46.

Consequently, when V nozzle 41 is aligned in position, water flows from pipe 15 through plate opening 31 into the nozzle 41, passing a screen placed in front of the nozzle 41 to spray. In a likewise manner, mist would form when the nozzle 43 is in position, water jet would form through nozzle 44, strong enough to meet cleaning purposes, while shower nozzle would provide a satisfactory service for pet bathing.

When nozzle 42 is aligned into position, inlet water is concentrated into hole 420, and then sent to recess 4211; then through radial grooves, water enters tangentially into hole 4213, producing mist through central hole 424. This is particularly suitable for watering small potted plants and delicates like orchids, as well as meadow spraying.

When trigger handle 5 is pressed, its upper end forces knob 6 to draw back the rod 2, and water flow starts within the gun. By the time the inner wall 55 of the upper end of trigger handle has departed from the rear end of the main body 1 of the gun for a considerable distance, the fixing loop 14 may be lifted through pivoting of folded part 141, 142 in side holes 13—13. The bulging part 143 of the loop in turn enters into the recess 51, shoulder parts 144, 145 thereof presses against the upper wall face 55, and the handle 5 thus can be held to maintain operation condition, while manual pressing can be released.

From the abovesaid, it may be seen that with the spray gun of the construction as described, with different nozzles selectively revolved into service, to meet various requirements, the sprays will range from finest mist to strongest jet would be capable of doing any job from watering of delicate plant, pet showering, unto floor cleaning, so that the gun it meets the multi-purpose requirement. Further more, with welding of collar 27 to pipe 15 and the provision of seals 26, 28 the construction is sufficiently leak-proof; besides, since for the connection of trigger handle to the main body, instead of conventional riveting, clip-on method is used, so as to eliminate man hour consumed in the assembling, the cost is reduced and maintenance simplified. With these features, the present invention is novel and full of inventive ideas.

What is claimed is:

1. A multiple purpose water spray gun comprising:

a main body having a front end and a rear end and including a handle and a water supply pipe;

a water control rod extending into the water supply pipe of the main body and having front and rear ends;

a press trigger handle mounted on the rear end of the main body for movement between a depressed position and a released position;

a fixing loop clipped to the rear end of the main body and movable between an active position in which it holds said press trigger handle in the depressed position thereof and an inactive position in which it permits said press trigger handle to move between the depressed and released positions thereof; a revolving ring mounted on the front end of the main body for turning about a turning axis which is transversely offset from the water supply pipe, and having a plurality of different nozzles distributed on the ring along a circle centered on the turning axis and having such a diameter that the nozzles are selectively alignable with the water supply pipe by turning the revolving ring, said nozzles including:

a rain drop nozzle including a wall portion of said revolving ring having a recess and a concentration hole formed centrally of the recess, and a controlling part received in the recess, covering the concentration hole, extending radially outwardly beyond the concentration hole, and having a central cavity, a plurality of outlet holes distributed around said cavity, and a plurality of grooves extending radially outwardly from said central cavity and each leading tangentially to a different one of said outlet holes, each of said outlet holes having a central micro exit to form micro rain drops, and a mist nozzle including another wall portion of said revolving ring having another recess, a plurality of radially disposed ribs formed in said other recess and integrally with said revolving ring, a recessed nozzle member supported in said other recess by said ribs and having a circumferential surface, a front end face, and two diametrically disposed slots starting from said circumferential surface of said nozzle member and leading toward said front end face, a cover covering up said nozzle member and having a central opening communicating with said slots so that water flowing through said opening forms a mist cone; and a plurality of water seal rings disposed at both front and rear ends of said water control rod.

2. The multiple purpose water spray gun according to claim 1, wherein said water control rod has a plurality of water guide fins disposed at said front end thereof; wherein said water outlet pipe has a front end having an outlet; and further comprising another water seal disposed in front of the fins, a water stop collar fixed to the outlet of said front end of said water supply pipe by ultrasonic welding and having a restricted front end, and a further seal disposed on said restricted front end of said collar to ensure leak-proof sealing.

* * * * *